US008179247B2

(12) United States Patent
Ivtsenkov et al.

(10) Patent No.: US 8,179,247 B2
(45) Date of Patent: May 15, 2012

(54) INTERROGATOR-TRANSPONDER RF SYSTEM FOR PREVENTION OF HUNTING ACCIDENTS

(76) Inventors: Gennadii Ivtsenkov, Hamilton (CA); Alexandre Mantsvetov, Burlington (CA); Evgeny Berik, Tartu (EE)

( * ) Notice: Subject to any disclaimer, the term of this patent is extended or adjusted under 35 U.S.C. 154(b) by 419 days.

(21) Appl. No.: 12/557,574

(22) Filed: Sep. 11, 2009

(65) Prior Publication Data

US 2011/0063102 A1 Mar. 17, 2011

(51) Int. Cl.
*G08B 23/00* (2006.01)

(52) U.S. Cl. ..... 340/505; 340/539.1; 340/572.1; 340/573.1; 340/825.69

(58) Field of Classification Search ..... 340/573.1, 340/572.1, 572.4, 505, 539.1, 539.22, 825.49, 340/825.69; 398/106, 108
See application file for complete search history.

(56) References Cited

U.S. PATENT DOCUMENTS

| | | | | |
|---|---|---|---|---|
| 7,573,369 | B2 * | 8/2009 | Hayles et al. | 340/10.32 |
| 2003/0147651 | A1 * | 8/2003 | Roes et al. | 398/108 |
| 2008/0042866 | A1 * | 2/2008 | Morse et al. | 340/691.1 |

* cited by examiner

*Primary Examiner* — Hung T. Nguyen

(57) ABSTRACT

The RF system for preventing hunting accidents comprising RF interrogator mounted on the firearm and RF transponder attached to hunter's coat, wherein sharp-diagram K-band RF channel of the interrogator, which is directed along the sight-line of hunter's rifle, provides alert information about "friendly targets" that could be under fire, such as other hunters or persons and animals equipped with said transponder; and if they are, the system develops alert signal: "Do not shoot". Also, the system is optionally equipped with a trigger lock automatically preventing friendly fire.

4 Claims, 5 Drawing Sheets

Sharp-diagram horn antenna of the interrogator

Unidirectional rod antenna of the transponder (directional pattern)

Sharp-diagram horn antenna of the interrogator

Unidirectional rod antenna of the transponder (directional pattern)

INTERROGATOR-TRANSPONDER RF SYSTEM FOR PREVENTION OF HUNTING ACCIDENTS

CROSS-REFERENCE TO RELATED APPLICATIONS

This application is related to U.S. patent application Ser. No. 11/685,682, U.S. Provisional Application No. 61/061,098 and Canadian Patent No 2,549,727.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATED-BY-REFERENCE OF MATERIAL SUBMITTED ON A COMPACT DISK

Not Applicable.

FIELD OF THE INVENTION

This invention relates generally to systems protecting a person from friendly fire, such as radio (RF) based combat identification (IFF) systems for ground targets and more particularly to systems preventing hunting accidents, which use RF signals emitted by an interrogator and received by transponder of a target (another hunter) that sends RF response signal to prevent an accidental fire.

DESCRIPTION OF THE RELATED ART

The present invention is related to U.S. patent application Ser. No. 11/685,682, U.S. Provisional Application No. 61/061,098 and Canadian Patent No 2,549,727 filed by the authors of the present invention and dedicated to its civil application, particularly to hunter protection.

The problem of protection a hunter of accidental fire still unsolved. Each year, an alarming number of wild game hunters are accidentally shot by other hunters due to mistaken identity, poor visibility, or mere carelessness. Despite of some measures implemented by Hunter Associations, such as bright orange color of hunter's coat and hat, tragic accidents still continuously occur, especially in the case when the sightline is obstructed and hunter start firing on sound, which, he believes, belongs to animal.

From another hand, it is the solution based on experience with military friend-or-foe (IFF) identification systems. Particularly, the Dismounted Armed Forces have an interest in the remote identification of a person as friend or foe, particularly to prevent friendly fire in armed conflicts. Combat identification devices that are known as friend or foe (IFF) systems are well-known for decades for military aircraft. Such systems are based on RF transmission and very useful for preventing action against friendly aircrafts.

The military platform commanders target friend-or-foe identification presents a difficult decision for a military platform commander, who must decide whether to engage a detected target while avoiding accidental fratricide.

This problem is even more difficult for the dismounted soldier who may be moving covertly through an unknown combat zone at night in the conditions of limited visibility. The combined optical-radio IFF system dedicated to dismounted soldier was introduced in U.S. patent application Ser. No. 11/685,682 filed by the authors of the present invention. It comprises two channels—optical infrared and Ka-band RF ones, wherein the sharp-diagram optical channel works in the condition of direct visibility, and RF channel having larger diagram (about 17 arc degrees at 8-mm wavelength) gives to shooter information about possible friendly targets in the shooting area directed along the sightline.

For the system exclusively dedicated to prevent hunting accidents, mentioned IFF system can be utilized, but in simplified version containing sharp-diagram RF channel only. Unlike optical signal, RF one passes through the objects, which are not transparent for optical signals, but RF interrogator has relatively wide angular diagram determined by RF signal wavelength, antenna design and aperture.

There are some attempts to utilize RF and optical signal in hunter protecting systems. Two similar systems that, according to the author, can prevent hunting accidents, are described in U.S. Pat. No. 3,400,393 and US Patent Application No 20070205890. Here the authors propose RF system containing continuously-emitting RF beacon attached to a potential target and a sharp-diagram RF receiver mounted on hunter's rifle. The device—the object of these patents—is described in both patents in general form without any details and specifications, such as operational RF wavelength, antenna and unit design and characteristics, etc. The system of U.S. Pat. No. 3,400,393 containing parabolic reflector is bulky and not suitable for hunting. Also, continuously-emitting RF transmitter (beacon) proposed in this Patent and Patent Application continuously consumes energy of battery that is not suitable for miniature device. Another idea generally proposed in mentioned Patent and Patent Application is a reflector, RF or optical, attached to a possible target. In this case, hunter's riffle is equipped with full transmitting/receiving unit working as a radio locator. Even though no details or specifications are given by the author about possible design of this system, simple analysis shows that such system can not properly works because of multiple reflections from objects in hunting area, which can not be separate from a "friendly target".

Other attempts to utilize RF transponders to protect hunters are proposes in U.S. Pat. No. 4,833,452 and U.S. Pat. No. 5,307,053. These systems contain transponders which antennas has omnidirectional diagram. According to the patent, each hunter is equipped with such transponder, wherein each transponder sends RF signals to others that is in the area. Therefore, each hunter has information that a number of hunters is in this area. It gives them alert signal: "Be careful!".

The systems proposed in mentioned Patents provide just general information about existence of hunters equipped with the transponder in surrounding area, but it does not specify position of each hunter, so such alert can confuse the hunter.

Another system proposed in U.S. Pat. No. 5,183,951 also comprises RF transponders mounted on a rifle of each hunter who participates in the hunting. According to the author, these transponders exchange signals so inform a hunter about presence of other hunters in the area. Despite of very general description of this device where the author mostly pays attention to device attachment on a rifle and does not provide any technical specification, it is obvious that such device is unidirectional one and can not provide information about position of each hunter, therefore this device is useless to really protect hunters from accidental shooting.

Unlike the system proposed in U.S. Pat. No. 5,307,053, RF channel of IFF system described in U.S. patent application Ser. No. 11/685,682 comprises a rifle-mounted interrogator utilizing short-wavelength signal that allows organizing narrow-diagram RF ray directed along the sightline. Therefore, the RF antenna with 30-mm aperture has the transmitting/receiving diagram of about 17 arc degrees at 8-mm RF wavelength (30-meter-width area at 100-meter distance), or 10-arc degree diagram at 5-mm wavelength (17-meter-width area at 100-meter distance). Such diagram allows recognizing a hunter that is situated in the area of shooting; and, if the interrogator has the single transmitting/receiving antenna, the interrogator receives response signal comes exactly from this area.

The system of the present invention contains components that available on the market; it is inexpensive, small in size and weight. FIG. 1 illustrates operation of the system in the case when the sightline is obstructed.

SUMMARY OF THE INVENTION

The present invention is dedicated and customized as a system preventing hunting accidents.

The system can save lives especially in the situation when the sightline is shaded by leafs, trees, etc; and when hunter starts shooting in the direction of noise produced by hunted animal or in the direction of unidentified object.

The working distance of the system is up to 100 meters, which can be optionally enlarged to a few of hundred meters. The system provides two-way RF interrogator-transponder communication, wherein said interrogator is mounted on hunter's rifle and said transponder is attached to hunter's coat. To prevent possible shadowing of the request signal by hunter's body (when he turn his back to the shooter), it can be two similar transponders mounted on front and back of hunter's coat (see FIG. 2).

THE DRAWINGS

DETAILED DESCRIPTION OF THE PREFERRED EMBODIMENT OF THE INVENTION

RF System for Preventing Hunting Accidents

Figure 1:
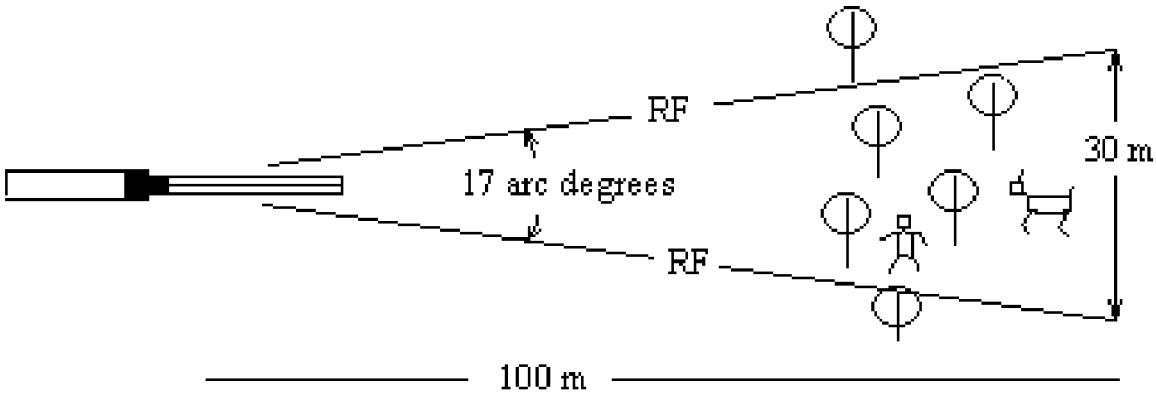
FIG. 1 illustrates operation of the system of the present invention.
Figure 2:
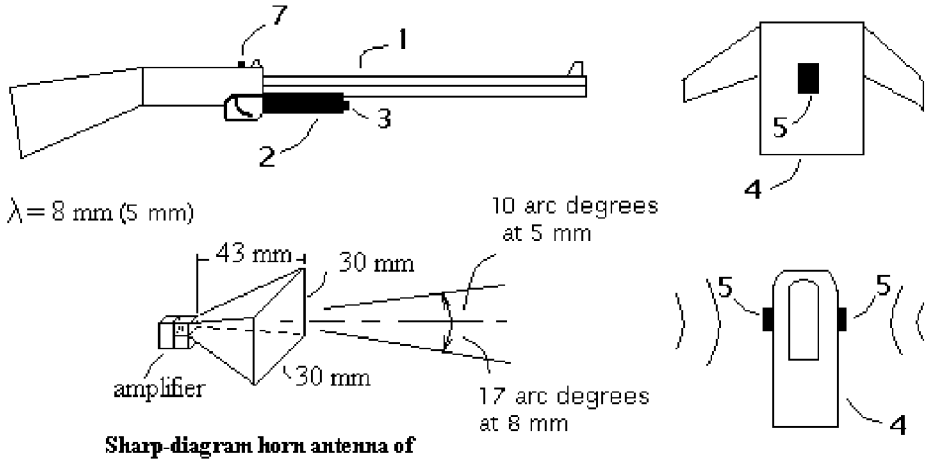
FIG. 2 depicts of possible design of interrogator's transmitting antenna and position of units on the rifle and hunter coat.
Figure 2:
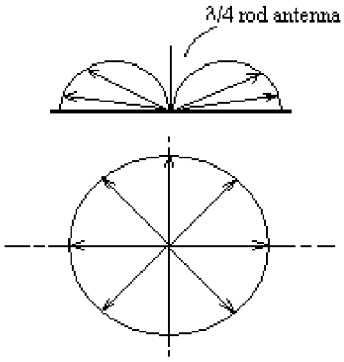

The schematic diagram of elements of the prevention system of the present invention is depicted in FIG. 2.

The system for prevention of hunting accidents—the object of the present invention—includes a RF interrogatory (request) unit 1 and a RF transponder (response) unit 5 sending RF response signal when it is activated by the request signal of the interrogator, wherein the interrogator is mounted on hunter's rifle 1 and the transponder 5 attached to hunter's coat 4 in any convenient place.

The interrogator contains transmitting (request) RF channel operating in short-wavelength Ka band and having sharp diagram provided by antenna 3, which is essential for the system operation. The response channel of the transponder, which, unlike the request channel, does not require sharp-diagram RF ray can operate in the same waveband as the interrogator (Ka band), or utilize any conventional waveband, such as Ku or L band.

Both units—the interrogator and transponder—contain RF transmitter/receiver and are equipped with transmitting and receiving antennas so providing two-way RF signal exchange. Therefore, each hunter has a set of two RF units—the rifle-mounted interrogator 2 and the transponder 5 attached to his coat 4. If it is a passive target, such as hunter's hound, it can be equipped by the transponder only.

Wavelength of RF signal of this system has options, but wavelength of the request signal has to be shortest as possible because antenna's directivity directly depends on the wavelength. From another hand, RF signal of short (such as 5 mm) wavelength highly absorbs by some media, such as water vapor, and by some materials, such as leafs, wood, etc. Also, a human body can shadow such RF signal. Because of this, the hunter using the system of the present invention can be equipped with two transponders, wherein one of them is attached to the front of hunter's coat, and another one—to the back of hunter's coat. Therefore, the RF signal sent by the interrogator can reach at least one of transponders without obstacles, so making the system more reliable.

The RF channel of the interrogator—the object of the present invention—utilizes the short-wavelength (Ka band) RF signal that allows emitting RF signal in a narrow (for small 30×30-mm-aperture antenna) sector of about 17 arc degrees directed along the sightline of the firearm. The characteristics of horn waveguide transmitting antenna of the interrogator (3×3-cm aperture) at 8-mm wavelength are follows:

| | |
|---|---|
| Wavelength | 8 mm (37.5 GHz Ka band), |
| Aperture | 3 × 3 cm (9 $cm^2$), |
| Coefficient of directivity | G = 176, |
| Directional pattern (at 3 dB) | $\gamma$ = 17 arc degrees. |

If shorter wavelength is used, characteristics (such as directivity) of the antenna become better. Thus, characteristics of horn waveguide transmitting antenna having the same aperture, but utilizing 5-mm wavelength are follows:

| | |
|---|---|
| Wavelength | 5 mm (60 GHz Ka band), |
| Aperture | 3 × 3 cm (9 $cm^2$), |
| Coefficient of directivity | G = 452, |
| Directional pattern (at 3 dB) | $\gamma$ = 10 arc degrees. |

The possible design of the antenna is depicted in FIG. 2.

The antennas and electronics of the request channel—the transmitter of the interrogator and the receiver of the transponder—are operate at the same wavelength of Ka band, whereas the antennas and electronics of the response channel—the transmitter of the transponder and the receiver of the interrogator—can also operate in Ka band or utilize another conventional wavelength, such as Ku or L band.

Because of this, the antennas of the response channel are the unidirectional ones, so they have simple design such as ¼-wavelength rod or half-wavelength dipole.

Directional pattern of unidirectional ¼-wavelength rod antenna is shown on FIG. 2.

The hardware of Ka-band RF channel (used for interrogator-transponder communication) is now available on the market and relatively inexpensive. Also, if Ku-band or L-band is used for response signal, its hardware of RF channel is also well-developed, has a small size and weight, and inexpensive.

Figure 3:
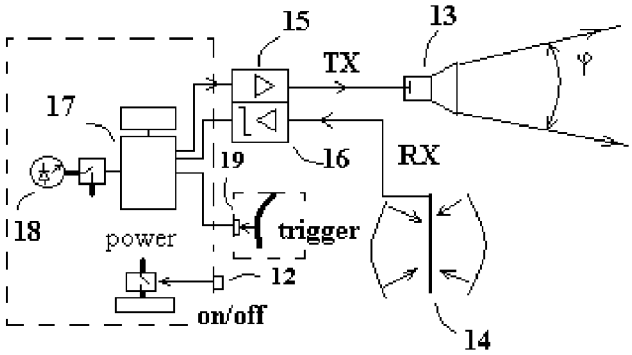
FIG. 3 depicts the schematic diagram of the interrogator of the preferred embodiment utilizing dual-wavelength RF channel.

The block-diagram of the interrogator of the preferred embodiment (position 3 on FIG. 2) is depicted in FIG. 3. The interrogator is mounted on hunter's rifle. It contains Ka-band RF transmitting unit that includes electronic block 15 and transmitting antenna 13 directed along the sightline, L-band unidirectional receiving antenna 14 and electronic block 16, processor 17, micro-switch 19 activating the interrogator, power switch 12 and alert light 18 mounted on the sight of hunter's rifle.

The interrogator is activated by touching the trigger that is connected to micro switch 19. Also, the micro switch 19 can be remote one using capacity between hunter's finger and a sensor that is incorporated in the interrogator. In this case, to activate the interrogator a hunter needs simply put his finger in proximity with said sensor.

Figure 5:
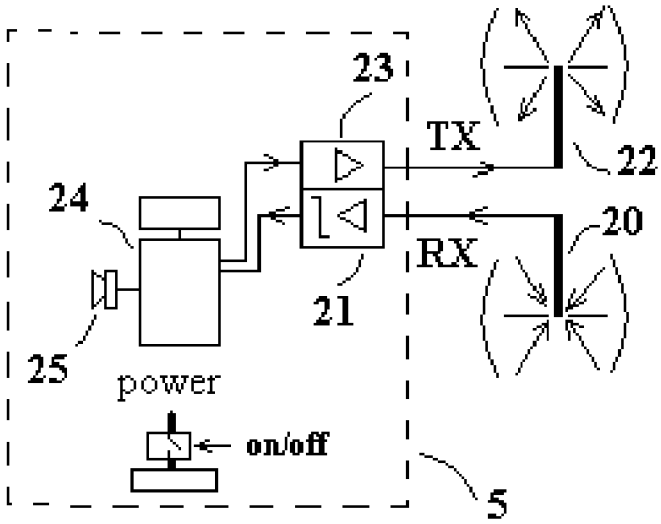
FIG. 5 depicts the schematic diagram of the transponder of the preferred embodiment utilizing dual-wavelength RF channel.
Figure 6:
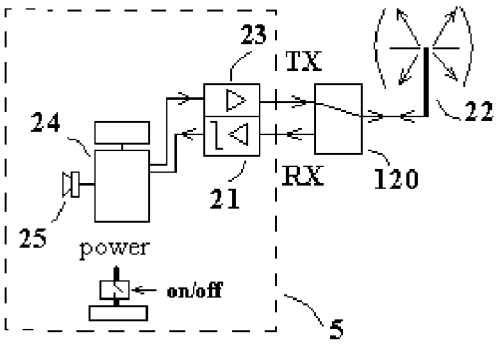
FIG. 6 depicts the schematic diagram of the transponder of the preferred embodiment utilizing single-wavelength RF channel.

The block-diagram of the transponder of the preferred embodiment (position 5 on FIG. 2) is depicted in FIG. 5. It contains unidirectional Ka-band receiving antenna 20 and electronic block 21, unidirectional L-band (or Ku band) transmitting antenna 22 and electronic block 23, processor 24 and alert buzzer 25.

The system operates as follows:

- In the waiting mode the interrogator is activated when a hunter touch a trigger,
- In the waiting mode the receiver of the transponder is switched on for all time of hunting,
- Operating mode starts when a hunter directs the rifle to a target; so he touches a trigger (or special knob),
- The interrogator sends request RF signal to the area covered by antenna's diagram (width of the RF beam is about 30 meters at 100-meter distance and 8-mm wavelength, or 17 meters at 100-meter distance and 5-mm wavelength),
- If another hunter or another "friendly target" is in this area, the transponder of the target receives the request signal (by means of unidirectional Ka-band antenna) and its processor develops the response signal transmitted to the interrogator via unidirectional L-band (or Ku band) antenna; simultaneously, the processor activates buzzer and red alert light (optional) telling to the target: "You can be under fire!"
- L-band (or Ku band) unidirectional antenna of the interrogator receives the response signal and interrogator's processor activates red alert light mounted on rifle's sight telling to the shooter not to shoot.

The RF signal emitted the interrogator and transponder, unlike encrypted signal of military IFF systems, has simple structure and consists of a few pulses. Such structure is enough to select the signal from electromagnetic interference produced by other sources.

Also, implementation of two different-waveband channels, particularly Ka band for interrogator-transponder connection and L band (or Ku band) for transponder-interrogator connection, allows avoiding crosstalk between the channels. Cost of hardware of L-band (and Ka band) electronics is low that allow creating the inexpensive system.

The interrogator and transponder of the present embodiment can utilize the same wavelength, wherein separation of the request and response channels is performed by signal coding. In this case, the transponder receives the coded request signal, process it, develops coded response signal and sends it to the interrogator. The interrogator receives the response signal, decodes it, recognizes the signal as the response one and activates the alert signals.

Another Embodiment of the Invention

Rf System for Preventing Hunting Accidents Having Interrogator and Transponder that Utilize RF Switch and Single Antenna Another way of implementation of single waveband RF signal for both, request and response channels that utilizes a RF switch—another embodiment of the present invention—allows significantly simplifying design, minimizing size and weight of the units. In this case each unit—the interrogator and transponder—comprises a single antenna and a RF switch that is sequentially and programmable connects the antenna to unit's transmitter and receiver, wherein the single antenna of the interrogator is a sharp-diagram Ka-band antenna, and the single antenna of the transponder is a unidirectional Ka-band antenna.

Figure 4:
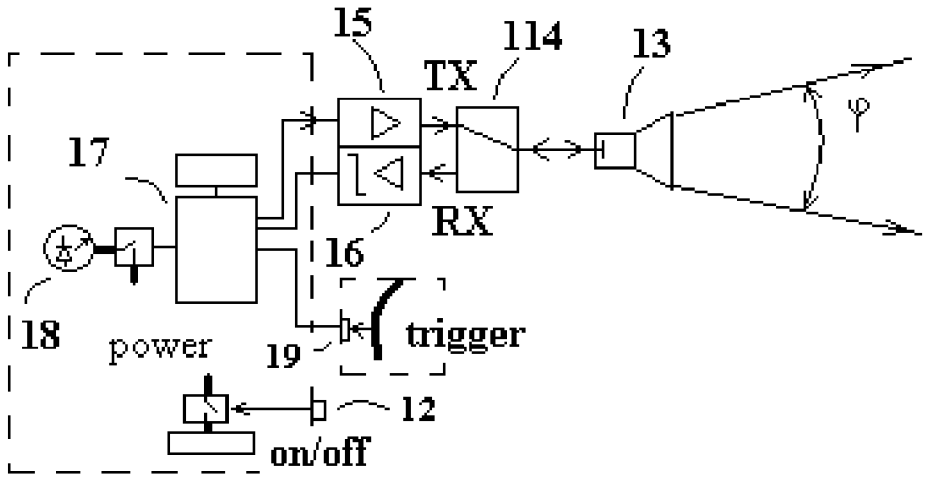
FIG. 4 depicts the schematic diagram of the interrogator of the preferred embodiment utilizing single-wavelength RF channel.

The block-diagram of the interrogator of this embodiment is depicted in FIG. 4. It contains Ka-band RF transmitting/receiving unit that includes: transmitting electronic block 15, receiving electronic block 16, single antenna 13, RF switch 114 sequentially connecting blocks 15 and 15 to antenna 13, microprocessor 17, micro-switch 19 activating the interrogator, power switch 12 and alert light 18 mounted on the sight of hunter's rifle. The request signal is simply coded (about 6 bit) that increase protection of the system from interference and crosstalk. The microprocessor 17 develops the request coded signal that is sent to the transponder via transmitting electronic block 15, switch 114 and antenna 13. After sending the request signal, the switch 114 immediately (in millisecond) connects the receiving electronic block 16 to antenna 13, so the interrogator is waiting for response. Received response signal is processed by the microprocessor 17 that activates the alert light 18.

The interrogator is activated by touching the trigger that is connected to mechanical micro switch 19. Optionally, it can be a remote sensor incorporated in the interrogator. Therefore, to activate the interrogator a hunter need touch the trigger or simply put his finger in proximity with the remote sensor.

The block-diagram of the transponder of this embodiment is depicted in FIG. 5. It contains Ka-band RF transmitting/receiving unit that includes: receiving electronic block 21, transmitting electronic block 23, single unidirectional Ka-band antenna 22, RF switch 120 sequentially connecting blocks 21 and 23 to antenna 22, microprocessor 24 and alert buzzer 25.

The response signal is also simply coded (about 6 bit) by different code. Optionally, the response code can be the same as the request code, but different codes allow additionally increasing crosstalk protection. In waiting mode the transponder is switched on for all time of hunting and the switch 120 connects the receiving electronic block 21 to antenna 22, so the transponder is continuously waiting for request signal. When the request signal is received the microprocessor 24 processes the signal and send commands to the switch 120 that immediately connects transmitting electronic block 23 to antenna 22. The microprocessor develops the request coded signal that is sent to the interrogator via transmitting electronic block 23, switch 120 and antenna 22. Also the microprocessor 24 activates the alert buzzer 25.

The operational wavelengths of this system and coding of the request and response signals can be unified (certified) for all hunter-protecting systems, so any hunter can recognize another hunter or a "friendly target" equipped with such transponder.

The system operates as follows:

In the waiting mode the switch 114 connects antenna 13 of the interrogator to transmitter 15, wherein the interrogator is activated when a hunter touch a trigger, In the waiting mode the switch 120 connects antenna 22 of the transponder to receiver 21, wherein the receiver is switched on for all time of hunting, Operating mode starts when a hunter directs the rifle to a target; so he touches a trigger (or special knob), The interrogator sends request RF signal to the area covered by antenna's diagram (width of the RF beam is about 30 meters at 100-meter distance and 8-mm wavelength, or 17 meters at 100-meter distance and 5-mm wavelength), If another hunter or another "friendly target" is in this area, the transponder of the target receives the request signal (by means of unidirectional Ka-band antenna); the processor recognizes the request signal, sends command to the switch, which connects unit's transmitter to the antenna, develops the response signal that is transmitted back to the interrogator via the single unidirectional Ka-band antenna; simultaneously, the processor activates buzzer and red alert light (optional) telling to the target: "You could be under fire!".

Ka-band unidirectional antenna of the interrogator receives the response signal and interrogator's processor activates red alert light mounted on rifle's sight so telling to the shooter not to shoot.

Another Embodiment of the Invention

RF System for Preventing Hunting Accidents Having Trigger Lock

This system is a modification of the preferred embodiment, which additionally comprises electro-mechanical lock mounted on triggering mechanism of hunter's rifle and activated by interrogator's processor in the case when the response signal sent by the transponder is received. This lock automatically stops trigger so preventing "a friendly fire". The possible design of the trigger lock is depicted in FIG. 5. Here the solenoid 31 has a rod consisting of magnetic part 32 and not-magnetic part 33. When the solenoid 31 is activated by electric current developed by electronic block of the interrogator, the magnetic part 32 of the rod is pulled inside by magnetic field. It pushes outside the not-magnetic part of the rod, which stops trigger from moving further.

Because in some cases, for example when dangerous animal is hunted, automatic locking of the trigger can be unsafe for the hunter, the lock can be manually deactivated.

Interrogator Design

Figure 7:
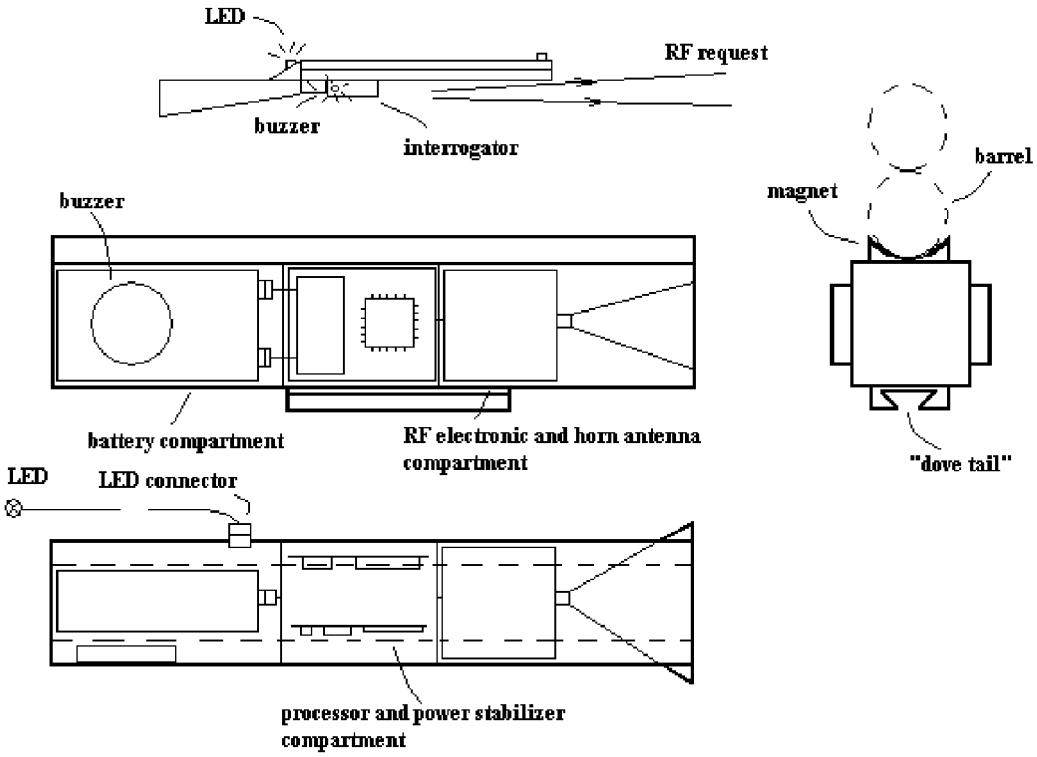
FIG. 7 depicts the possible design of the interrogator.
Figure 8:
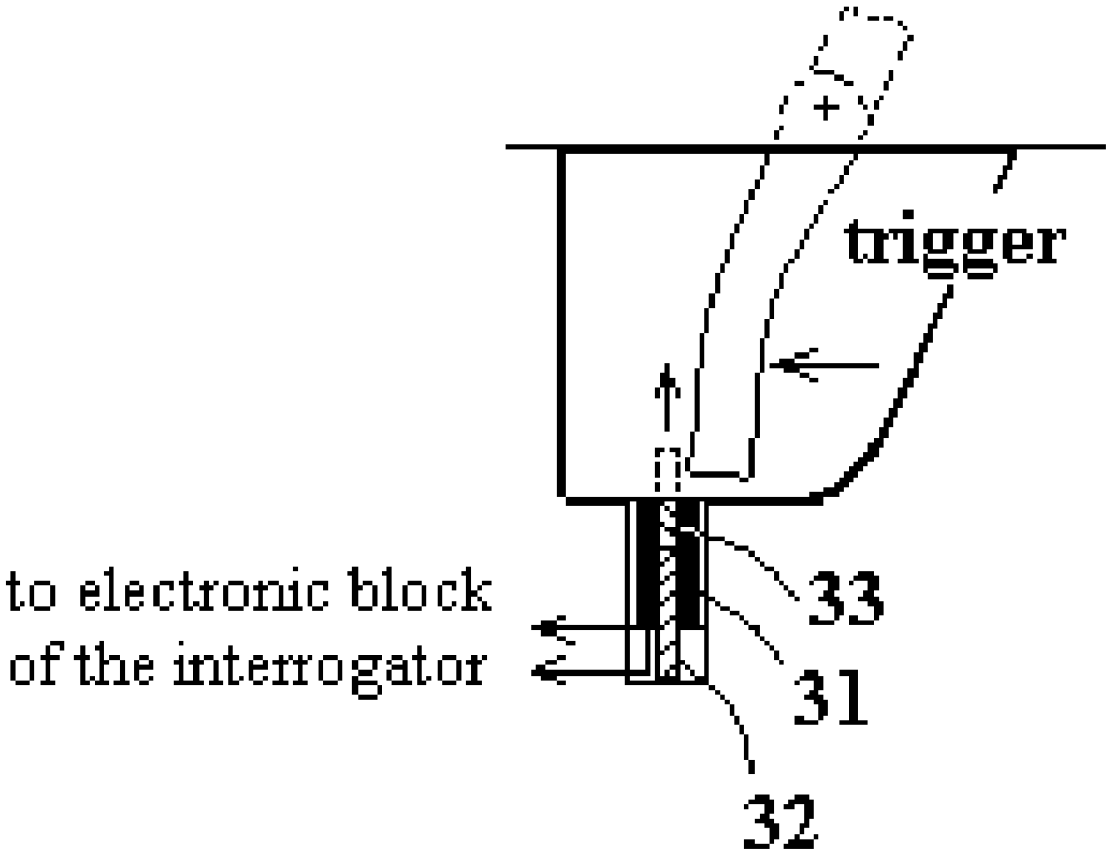
FIG. 8 depicts the possible design of trigger lock.

The possible design of the interrogator using the single horn antenna is shown on FIG. 7. It has rectangular shape and consists of battery compartment, processor and power stabilizer compartment, RF electronic and horn antenna compartment. The interrogator is fixed on rifle barrel by magnets; so installation of the interrogator on hunter's rifle does not requires any rifle modification—it can be attached to the barrel in any convenient place. Also, it can be attached to hunter's rifle by means of "dove tail" joint with which most of hunter's rifle is equipped.

What is claimed is:

1. A RF system for preventing hunting accidents comprising:

attached to a shooter an interrogator that comprises RF signal source arranged to radiate request signals, a RF detection system including a microprocessor, and an alert information system that is activated by received response signal, attached to a friendly target a transponder comprising RF detection system including a microprocessor, a RF signal source that is arranged to radiate said RF response signals, and an alert information system that is activated by said received request signal;

wherein said interrogator is mounted on a firearm, which contains a transmitter equipped with a sharp-diagram RF Ka-band antenna that sends a RF request signal in area to which sightline of said firearm is directed, and a receiver equipped with a unidirectional antenna that receives a RF response signal emitted by said transponder, wherein said RF response signal has wavelength that is different from wavelength of said RF request signal, one or more said transponders attached to uniform of friendly target in any convenient place, which contains a receiver equipped with a unidirectional Ka-band antenna that receives said RF request signal emitted by said interrogator and a transmitter equipped with a unidirectional antenna that sends said RF response signal to said interrogator; wherein said RF response signal utilizes wavelength matched with operational wavelength of said receiver of said interrogator, and said RF request signal utilizes wavelength matched with operational wavelength of said receiver of said transponder, said microprocessor controlling said transmitter and receiver of said interrogator, which develops said request signals and processes an input RF response signal, said microprocessor controlling said transmitter and receiver of said transponder, which processes said input RF request signals and develops said response signal, an alert light mounted on sight of said firearm and activated by said microprocessor of said interrogator, an alert buzzer incorporated in said transponder that is activated by said microprocessor of said transponder.

2. The RF system of claim 1 comprising:

a. the transponder, which transmitter and receiver operate at the same Ka-band wavelength as the transmitter and receiver of the interrogator;

b. the interrogator, which transmitter and receiver operate at the same Ka-band wavelength as the transmitter and receiver of said transponder, wherein separation of request and response signals is performed by means of signal codes that are developed by the microprocessors installed in said interrogator and said transponder; wherein said response signals has a digital code that differs from digital code of said request signal.

3. The RF system of claim 1 comprising:

the transponder, which transmitter and receiver operate at the same Ka-band wavelength as the transmitter and receiver of the interrogator of, equipped with a single Ka-band unidirectional antenna, wherein said transponder additionally comprises a RF switch programmable connecting said antenna to the transmitter and the receiver of said transponder; wherein separation of received request and sent response signals is performed by means of RF switch controlled by the microprocessor of said transponder, the interrogator, which transmitter and receiver operate at the same Ka-band wavelength as the transmitter and receiver of said transponder, equipped with a single Ka-band sharp-diagram antenna, wherein said interrogator additionally comprises a RF switch programmable connecting said antenna to the transmitter and the receiver of said interrogator; wherein separation of sent request and received response signals is performed by said switch controlled by the microprocessor of said interrogator.

4. The interrogator of claim 1 additionally comprising an electromagnetic trigger lock mounted on the firearm, which is automatically activated by received response signal, wherein said lock has option to be manually inactivated.

* * * * *